United States Patent [19]

McCoy

[11] 4,132,629

[45] Jan. 2, 1979

[54] HYDROCARBON CRACKING

[75] Inventor: Raymond D. McCoy, Bartlesville, Okla.

[73] Assignee: Phillips Petroleum Company, Bartlesville, Okla.

[21] Appl. No.: 514,933

[22] Filed: Oct. 15, 1974

[51] Int. Cl.[2] ..... C10G 11/18

[52] U.S. Cl. ..... 208/113; 23/232 C; 208/164; 208/DIG. 1

[58] Field of Search ..... 208/120, 113, 164, DIG. 1

[56] References Cited

U.S. PATENT DOCUMENTS

| | | | |
|---|---|---|---|
| 3,152,980 | 10/1964 | Coonradt et al. | 208/78 |
| 3,316,170 | 4/1967 | Stewart et al. | 208/164 |
| 3,384,573 | 5/1968 | Gorring | 208/113 |
| 3,791,962 | 2/1974 | Demmel et al. | 208/120 |
| 3,828,171 | 8/1974 | Griffin | 208/164 |

*Primary Examiner*—Herbert Levine

[57] ABSTRACT

A cracking reactor is controlled in response to the proportion of heavy aromatic constituents in a feedstock to be cracked.

14 Claims, 7 Drawing Figures

HYDROCARBON CRACKING

This invention relates to the cracking of hydrocarbon feedstocks. In another aspect the invention relates to control of a cracking reactor. In yet another aspect the invention relates to the use of a feedstock characterization to control a cracking reactor. In still another aspect the invention relates to control of a cracking reactor in response to the proportion of heavy aromatics in a feedstock to be cracked.

In the operation of a cracking reactor, particularly a fluidized bed catalytic cracker, the reaction product distribution is determined not only by the temperatures and flow rates within and associated with the reactor but also by the composition of feed which is cracked within the reaction zone of the cracking reactor. To obtain the best or most efficient product distribution requires maintaining an optimum, but not necessarily a maximum, conversion level, with the conversion level being defined as the amount of fresh feed converted or cracked to the products of reaction or, in another aspect, the destruction of feed material. Such an optimum conversion level will change as a function of the ease with which the feed material can be cracked. Although measurement of the reaction product distribution to determine whether or not the conversion level should be changed, followed by appropriate alterations of the reaction condition within the cracking reactor, can be used as a method of controlling and maintaining an optimum conversion level, it is desirable to predictively control the cracking reaction in response to changes in feed composition without the necessity of waiting for a change in feed composition to affect the reaction product distribution.

It is therefore an object of the invention to provide a cracking method and apparatus. An additional object of the invention is to provide a method and apparatus for control of a cracking reactor. Still another object of the invention is to provide a method and apparatus for controlling a cracking reactor in response to the composition of a feed stream to be cracked. Yet another object of the invention is to provide a method and apparatus for operating a fluidized bed catalytic cracker.

In accordance with the invention a feedstock to be cracked is analyzed to determine the proportion of heavy aromatic constituents within the feedstock, and the value of this proportion is used to control the reaction conditions within the cracking zone of a cracking reactor. It has been found that the proportion of heavy aromatic constituents within a feedstock is a valuable measurement which can be used to characterize a feedstock in terms of the ease with which the feedstock can be cracked. In particular, the ratio of heavy aromatic constituents to total aromatic constituents has been found to be a feedstock characterization which can be advantageously used to maintain an optimum conversion rate within a cracking zone. The present invention is particularly useful since feedstock composition is ordinarily an uncontrolled variable in a cracking process.

The invention can be used in conjunction with nearly any cracker optimization and control system. Such an optimization and control system can vary in complexity. The present invention could be incorporated into a control system such as the one disclosed in U.S. Pat. No. 3,828,171 or the system disclosed in U.S. Pat. No. 3,316,170 or other similar control systems, or could be used in a much simpler control system in which the feed characterization measurement could be utilized to adjust a single process variable. In any specific application, the most advantageous variable or combination of variables to control, the degree of control to exercise, the direction of change of a variable, the constraints imposed on the amount and rate of change of a controlled variable, and the exact amount of change to impose in response to a given change in feed characterization will be dependent on the physical and chemical characteristics of the particular processing unit and the reaction taking place therein and on the objectives in controlling the particular unit. For example, an increase in the heavy aromatic content of the feed to a fluidized bed catalytic cracker having a catalyst regenerator associated therewith could indicate an expected buildup of coke on the catalyst. The control system could then be designed to increase the catalyst regenerator air rate by an amount required to burn off the added catalyst coke expected from the change in feed composition. If the air rate called for by the control system exceeded a regenerator or control system constraint, another portion of the control system could decrease the fresh feed rate by an amount necessary to maintain the catalyst coke at a level within the capability of the regenerator. Over a normal operating range, a linear control system will usually be adequate in most applications although the invention can also be utilized in conjunction with more complicated or sophisticated systems.

Additional objects and advantages of the invention will be apparent from the following description of the drawings in which.

Figure 1:
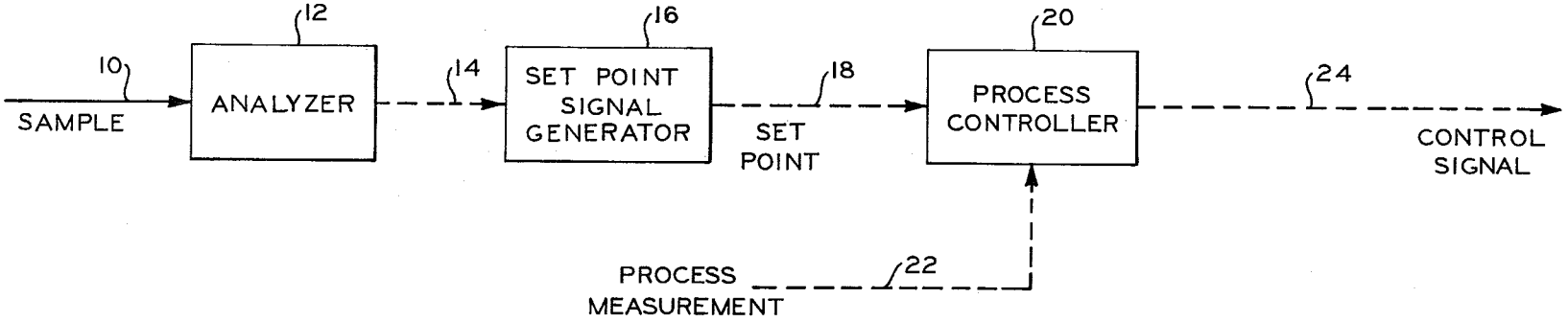
FIG. 1 is a schematic block diagram of the analysis and control signal generating portions of the invention.

Referring now to FIG. 1, there is illustrated the apparatus and process by which a sample of feedstock to be analyzed is passed through a sample conduit 10 to an analyzing means 12 which in turn delivers an analyzer output signal 14 to a set point signal generating means 16. Within the set point signal generating means 16 the analyzer output signal 14 is operated upon in order to produce a set point signal 18 representative of the desired value of a controlled process variable corresponding to the sample composition indicated by the analyzer output signal 14. A process controller 20 then compares the set point signal 18 with a process measurement signal 22 representing an actual measurement of the process variable to be controlled. In response to the relationship between the desired value of the controlled process variable as represented by the set point signal 18 and the actual value of the controlled process variable as represented by the process measurement signal 22, the process controller 20 generates a control signal 24.

The control signal 24 is then utilised to alter a process variable so that the process measurement signal 22 bears the desired relationship to the set point signal 18. The analyzing means 12 can be any analyzer capable of producing an acceptable output signal 14 representative of the composition of the sample within the sample conduit 10. One example of a suitable analyzer is the Optichrom™ liquid chromatographic analyzer manufactured by Applied Automation, Inc., Bartlesville, Oklahoma. The set point signal generating means 16 can be any means adapted for receiving the output signal 14 from a chromatographic analyzer and generating a set point signal 18 in response thereto. Although the analyzer output signal 14 will usually be electrical, specific process applications may require a pneumatic, hydraulic, or electrical set point signal 18, depending on the process controller 20 which is utilized. Any set point signal generating means 16 can be used to utilize pneumatic, hydraulic, electrical analog, or digital electronic, as well as any combination of these or similar means, to obtain the desired information from the analyzer output signal 14 and generate a suitable set point signal 18 in response thereto. The process controller 20 can be any such control means known in the art. One example of a suitable controller is the Quick-Scan 1300 electronic controller by Sybron Corp., Taylor Instrument Process Control Division, Rochester, New York.

Figure 2:
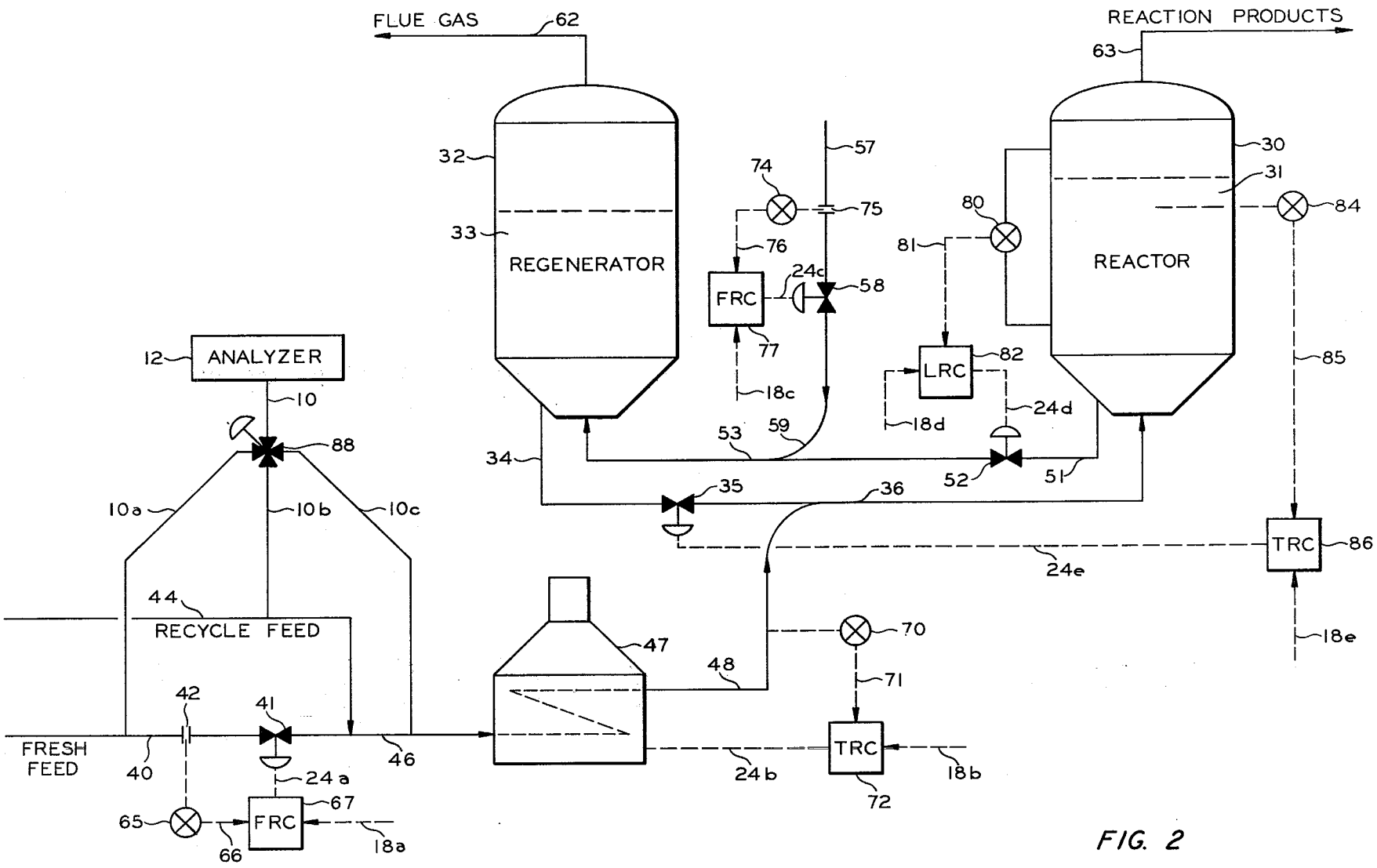
FIG. 2 is a schematic representation of a process employing the invention.

In FIG. 2 a cracking reactor, in this case a fluidized bed catalytic cracking reactor 30 having a reaction zone therein and an associated catalyst regenerator 32 having a catalyst regeneration zone therein, comprise a catalytic cracking apparatus. The catalyst regenerator 32 has a fluidized dense-phase bed 33 disposed therein. The regenerated catalyst flows into outlet conduit 34 and through a valve 35 into a conduit 36 leading to the reactor 30.

The feed to the reactor comprises a liquid petroleum or petroleum product or a similar type of hydrocarbon material from the freah feed conduit 40. In addition, a recycle feed stream such as a light cycle oil recycle stream or a heavy cycle oil recycle stream can be introduced through the recycle feed conduit 44 and mixed wth the fresh feed stream to provide a combined or total feed stream within conduit 46. The combined feed is passed through a preheater 47 wherein the total feed is heated to a desired temperature. The thus heated feed is then injected through a conduit 48 into the conduit 36. The regenerated catalyst within the conduit 36 is fluidized by the predominantly vaporous hot feed and the resulting fluidized mixture passes through the conduit 36 into the reactor 30. In addition to the regenerated catalyst and feed introduced into the reactor 30 superheated steam can be combined with the feed and catalyst mixture prior to introduction of the mixture into the reactor 30.

Within the reactor 30 the feedstream is cracked into various component parts by contact of the feedstream with the fluidized catalyst within the fluidized reactor bed 31. Heat for the cracking reaction is generated in the catalyst regenerator 32 and the preheater 47 and is carried to the reaction zone of the reactor 30 by the regenerated catalyst stream and the feedstream. A stream of spent catalyst is withdrawn from the reactor 30 through a spent catalyst conduit 51 and a valve 52 to a conduit 53. Air from any suitable source is introduced into the conduit 53 through an air supply conduit 57, a valve 58 and a conduit 59. The air thus injected into conduit 53 fluidizes the spent catalyst for conveyence into the catalyst regenerator 32 and provides the oxygen required for regeneration of the catalyst. Regeneration of the catalyst within the dense bed 33 of the regenerator 32 comprises combustion of coke or carbon which was deposited on the catalyst during the course of the cracking reaction taking place in the reactor 30. The gaseous products of the combustion reaction within the regenerator 32 are removed through a flue gas conduit 62.

The reaction products are removed from the reactor 30 through a reaction product conduit 63 for further processing and separation. A portion of the heavier constituents within the reaction product stream may subsequently be returned to the reactor 30 via the recycle feedstream conduit 44.

Control of a reactor 30 can be accomplished using a variety of different methods and apparatus or combinations of methods and apparatus. Preferred representative examples of control techniques which can be used individually, in combination with each other, or in combination with other control schemes are illustrated in FIG. 2. A flow rate transducer 65, in combination with an orifice flow meter 42 or other suitable metering device associated with the fresh feed conduit 40, produces an output signal 66 responsive to the flow rate of fresh feed to the reactor 30. A flow recorder-controller 67 compares the flow rate signal 66 with a set point 18*a* representative of the desired flow rate of fresh feed through the fresh feed conduit 40 and produces a control signal 24*a* in response to that comparison. By means of the control signal 24*a* the flow-recorder-controller 67 adjusts the position of valve 41 to maintain a fresh feed flow through the fresh feed conduit 40 equal to the flow represented by the set point signal 18*a*. Alteration of the flow of fresh feed to the reactor 30 will result in an alteration of the catalyst to feed ratio within reactor and will otherwise alter the magnitude and conversion level of the reaction within the reaction zone thereof.

A temperature transducer 70 associated with conduit 48 produces a temperature signal 71 responsive to the temperature of the material within the conduit 48. A temperature recorder-controller 72 generates a control signal 24*b* in response to a comparison between the temperature signal 71 and a temperature set point signal 18*b* representative of the desired temperature of material within the conduit 48. The control signal 24*b* controls the flow of fuel to the preheater 47 or is otherwise adapted to control the temperature to which the preheater 47 heats the feed material so that the temperature of the feed material leaving the preheater 47 through conduit 48 is the same as the temperature represented by the set point signal 18*b*. Alteration of the temperature of material flowing through the conduit 48 to conduit 36 and the reactor 30 will control the extent to which the feed to the reactor is vaporized and will also control the amount of heat carried to the reactor by the feed.

A flow rate transducer 74 associated with an orifice flow meter 75 or other suitable flow meter produces a flow rate signal 76 responsive to the rate of flow of air to the regenerator 32. A flow recorder-controller 77 produces a control signal 24*c* in response to a comparison between the flow rate signal 76 and a set point signal 18*c* representative of the desired rate of flow of air to the regenerator 32. The position of valve 58 is adjusted in response to the control signal 24*c* so that the amount of air flowing through conduit 57 and valve 58 is equal to the flow rate represented by the set point signal 18*c*.

Altering the rate of flow of air through conduits 59 and 53 into the regenerator 32 will result in a change in the combustion reaction within the regenerator 32 so that the temperature of the reaction within the generator 32 and/or the degree of catalyst regeneration will be controlled, thereby controlling the temperature and/or activity of the catalyst returning to the reactor 30.

A level transducer 80 associated with the reactor 30 produces a level signal 81 responsive to the level of the fluidized bed 31 within the reactor 30. A level recorder-controller 82 produces a control signal **24*d* in response to a comparison between the level signal 81 and a level set point signal 18*d* representative of the desired level of the fluidized bed 31 within the reactor 30. In response to the control signal 24*d* the position of the valve 52 is adjusted so that the flow of spent catalyst leaving the reactor 30 will be maintained at a rate which will keep the level of the fluidized bed 31 within the reactor 30 at a level corresponding to the level represented by the set point signal 18*d*. Alteration of the depth of the fluidized bed 31 within the reactor 30** will result in an alteration of the catalyst to feed ratio within the reactor as well as alteration of the dynamics of the cracking reaction.

A temperature transducer 84 associated with the reactor 30 produces a temperature signal 85 responsive to the temperature within the fluidized bed 31 of the reactor 30. A temperature recorder-controller 86 produces a control signal **24*e* in response to a comparison between the temperature signal 85 and a temperature set point signal 18*e* representative of the desired temperature within the fluidized bed 31 of the reactor 30. The amount of regenerated catalyst flowing through valve 35 is controlled in response to the control signal 24*e* in order to maintain the temperature within the fluidized bed 31 of the reactor 30 at a value equal to the temperature represented by the temperature set point signal 18*e*. Alteration of the rate at which regenerated catalyst is provided to the reactor 30 results in a change in the catalyst to feed ratio within the reactor and also changes the amount of heat which is carried by the catalyst from the regenerator to the reactor. Alteration of the temperature within the reactor 30** results in a change in the severity of cracking within the reaction zone.

Other similar control methods or alteration of the described control methods can also be used to control the conversion level and other similar reaction characteristics within the reactor 30. For example, control of the rate of flow of total feed to the preheater 47 rather than control of fresh feed flow could be advantageous, particularly in those circumstances where the recycle feed flow is subject to substantial fluctuation or where the recycle flow is substantial compared to the fresh feed flow. Using any of the described control methods alone, in combination with each other, or in combination with other control schemes, will result in an alteration of the conversion level and other reaction conditions within the cracking zone of the reactor 30 in response to a change in a set point signal **18*a*, 18*b*, 18*c*, 18*d*, or 18*e***.

A fresh feed sample conduit **10*a*, a recycle feed sample conduit 10*b*, and a total feed sample conduit 10*c*, connected to a sample selector valve 88, permit introduction of a feedstock sample into the sample conduit 10 of the analyzer 12**. Although in any particular application of the invention, sampling of only one feedstock, such as the fresh feed or the total fresh and recycle feed, will be utilized, analysis of any of the various feed streams is within the scope of the invention as is analysis of two or more such feed streams.

Figure 3:
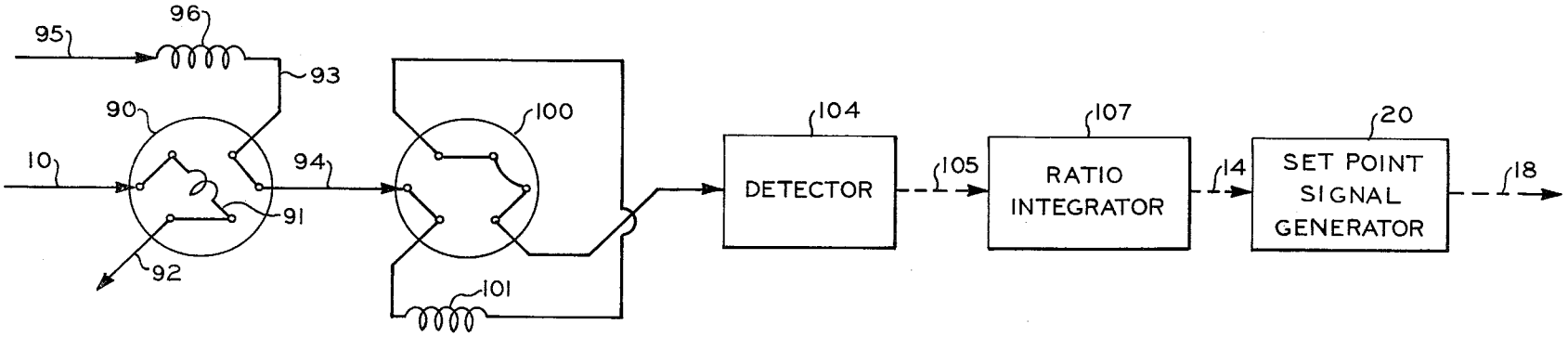
FIG. 3 is a schematic representation of the sampling system of the invention and a preferred set point signal generation apparatus and method.

A preferred analysis and set point signal generation method and apparatus are illustrated schematically by FIG. 3. A sample valve 90 has connected thereto the sample conduit 10, a sample loop 91, a vent conduit 92, a carrier inlet conduit 93, and an outlet conduit 94. The sample loop 91 can be located within the sample valve 90 or can be externally connected thereto. When the sample valve 90 is in the position illustrated, a portion of the feedstock to be sampled is introduced through the sample conduit 10 to the sample loop 91 and is vented through the vent conduit 92. Flow of the feedstock sample through the sample loop 91 maintains an up-to-date sample of the feedstock within the sample loop 91 ready for analysis. The carrier inlet conduit 93 receives a flow of a suitable carrier fluid from a carrier supply conduit 95. A drying column 96 for removing water from the carrier fluid or other suitable or desirable methods of carrier fluid preparation can be used to insure a pure and uniform supply of carrier fluid to the carrier inlet conduit 93. In the position of the sample valve 90 illustrated, the carrier fluid flows directly from the carrier inlet conduit 93 to the outlet conduit 94 and into a backflush valve 100. With the backflush valve in the position shown, the material flowing into the valve through the sample valve outlet conduit 94 will be directed through a chromatographic column 101 in a first or forward direction to a chromatographic detector 104. The chromatographic detector 104 can be any detection device suitable for use in detecting the sample constituents eluted from the chromatographic column 101 and producing a chromatographic detector output signal 105 representative thereof. For analysis of a liquid sample, for example, a detector 104 utilizing a differential refractometer to produce an output signal 105 responsive to the refractive index of the sample constituent is preferred.

A ratio integrator 107 associated with the analyzer 12 accepts the detector output signal 105 and automatically performs the necessary integration of the detector output signal 105 to determine the area under the output curves of two sample constituents. The ratio integrator 107 then divides the area under the curve of a first sample constituent by the area under the curve of a second sample constituent to generate an analyzer output signal 14 representative of the ratio of the first sample constituent to the second sample constituent within the feedstock sample. Although incorporation of the ratio integrator 107 into the analyzer 12 is preferred, the function performed by the ratio integrator 107 could be incorporated into a set point signal generator 20 which would accept the output of the chromatographic detector 104 and generate a set point signal 18 therefrom.

A suitable chromatographic detector 104 for use in analyzing a liquid sample can be an ultraviolet detector, a refractive index detector, a density detector, or other suitable detection means. Suitable detectors are those available with the Optichrom liquid chromatograph analyzer manufactured by Applied Automation, Inc. of Bartlesville, Oklahoma. A suitable ratio integrator 107 is available as a part of the Model 102 or Model 112 chromatograph programmers manufactured by Applied Automation, Inc. of Bartlesville, Oklahoma. A valve suitable for use as either the sample valve 90 or the backflush valve 100 is the Model IX diaphragm valve also manufactured by Applied Automation, Inc. of Bartlesville, Oklahoma. A chromatographic column 101 suitable for separation of the catalytic cracker feedstock for chromatographic analysis is a ⅛—inch diameter analytical column 2 feet long packed with nominal 20 micron size silica gel and maintained at a temperature of approximately 100° F. A suitable carrier fluid supplied by the carrier supply conduit 95 is hexane flowing at a rate of approximately one-half cubic centimeter per minute at a pressure of approximately 600 psig.

Figure 4A:
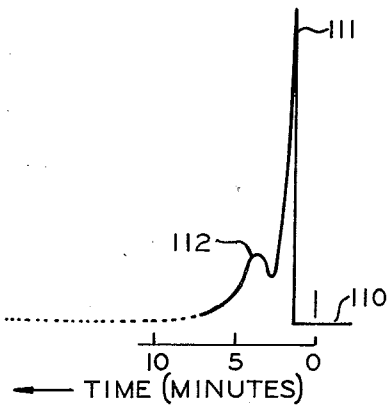
FIG. 4A is a representative chromatographic analyzer detector signal associated with the analyzer configuration of FIG. 4.
Figure 4:
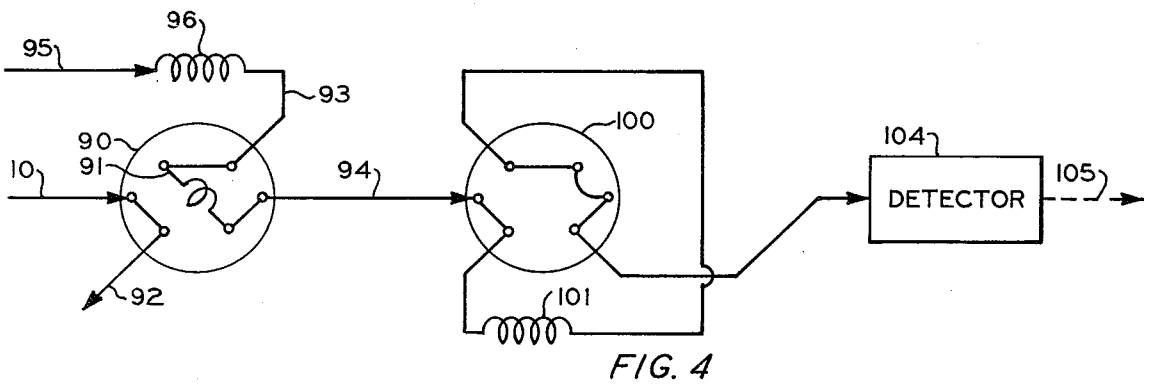
FIG. 4 is a schematic representation of the analyzing apparatus of the invention shown in a second position.

In FIG. 4 the sample valve 90 and backflush valve 100 are shown in the position which they assume immediately following the initiation of a sample analysis. The sample valve 90 has switched from the position illustrated by FIG. 3 to a second position wherein the feedstock sample within the sample loop 91 has been entrapped and placed in communication with the carrier inlet conduit 93 and the outlet conduit 94 so that the sample of feedstock within the sample loop 91 is carried by the carrier fluid to the backflush valve 100. In this position of the sample valve 90 the sample conduit 10 communicates directly with the vent conduit 92. The backflush valve 100 is maintained in the same position as shown in FIG. 3 so that the feedstock sample which had been contained within the sample loop 91 is transported by the carrier fluid in a forward direction through the chromatographic column 101 to the chromatographic detector 104.

A typical detector output signal 105 for a sample of catalytic cracker feedstock carried to the detector with the backflush valve 100 in the position illustrated in FIG. 4 is shown by FIG. 4A. During the time that the sample valve 90 and backflush valve 100 were in the position illustrated by FIG. 3, flow of the carrier fluid through the detector established a base line 110 for the detector output signal. The time at which the sample valve 90 is switched to the position illustrated by FIG. 4 is designated as time zero on the abscissa of the output curve. The first constituents of the feedstock sample to reach the detector 104 after having been eluted through the chromatographic column 101 are the constituents ordinarily designated as the saturates or paraffinic constituents and comprise generally all nonaromatic constituents of the sample. These constituents are eluted through the chromatographic column 101 fairly rapidly and at much the same rate so that a distinct nonaromatic chromatographic peak 111 is observed in the chromatographic detector output signal 105. The aromatic constituents of the feedstock sample are eluted through the chromatographic column more slowly than the nonaromatic constituents. The aromatic constituents form an aromatic peak 112 which, although there may be some overlap between the trailing edge of a nonaromatic peak and the leading edge of the aromatic peak, is clearly distinguishable from the nonaromatic peak. It has been found that despite the wide range of possible aromatic compounds contained within the sample, the aromatic constituents of the sample will elute through the chromatographic column 101 according to the number of aromatic rings within the structure of each composition with those compositions having a lesser number of aromatic rings passing through the chromatographic column 101 at a faster rate than those having a greater number of aromatic rings. Due to the large number of individual compounds which may be present in the sample, however, and due to the substantial variations which may be expected in the size of side chains, condensed cycle paraffin rings in a molecule, or other additional structural characteristics, there will be some overlap between otherwise generally separated aromatic ring structures and the aromatic content of the sample will be represented on the output signal 105 as a single peak 112. However, even with the overlapping of elution times for aromatic constituents having nearly the same number of aromatic rings, it is possible to measure relative changes in aromatic compound distribution and, by proper calibration using known compounds, to obtain a measure of aromatic compound distribution which can be used for control purposes.

If the backflush valve 100 were maintained in the position illustrated by FIG. 4 the trailing edge of the aromatic peak 112 would ordinarily resemble the curve represented by the interrupted line of FIG. 4A. This is due to the fact that there are ordinarily a number of heavy aromatic sample constituents which will take a long time to elute through the chromatographic column 101. In fact, most feedstocks to be cracked will have some heavy constituents which could take an hour or longer to elute through the chromatographic column 101. In addition to the obvious disadvantages of having to wait such a long time to complete an analysis of a sample, measurement of the trailing edge of the aromatic peak 112 to determine the amount of these heavier aromatic compounds in the sample is extremely difficult.

The heavy aromatic or light aromatic designation of constituents used in conjunction with the foregoing and following description is intended to designate a relative number of aromatic rings of the various constituent compounds. Although those compounds having a greater number of aromatic rings, either fused or separated, will, as a general rule, also have a relatively higher molecular weight or boiling point than those aromatic compounds having a lesser number of aromatic rings, the terms heavy and light when applied to aromatic constituents are not intended to designate either relative molecular weight or relative boiling point within the context of this disclosure. A heavy aromatic constituent is therefore one which has a higher number of aromatic rings than a lighter aromatic constituent. An accurate measurement of the amount of heavy aromatics present within the sample is particularly important since it has been found that the heavy aromatic content of many feedstocks is the feed constituent most subject to variation and since heavy aromatic compounds are generally the most difficult to crack.

Figure 5A:
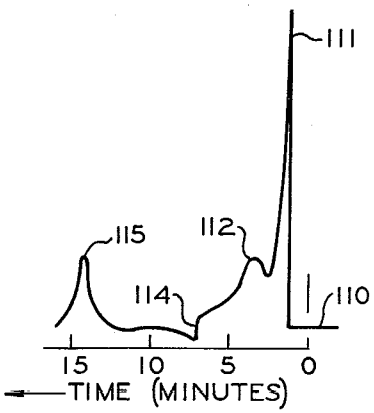
FIG. 5A is a representative chromatographic analyzer output associated with the apparatus configuration of FIG. 5.
Figure 5:
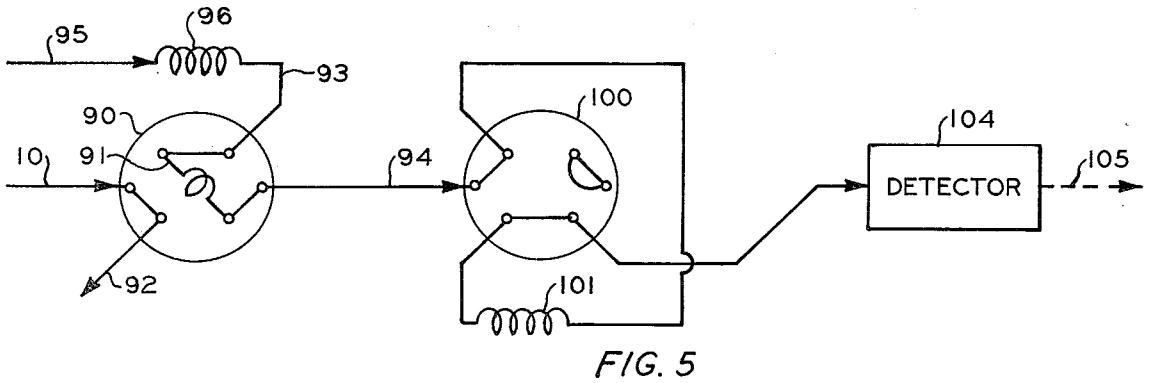
FIG. 5 is a schematic representation of a third condition of the chromatographic analyzing apparatus of FIG. 4.

After a length of time sufficient for the lighter aromatic constituents of the sample to have been eluted through the chromatographic column 101, the back flush valve 100 is switched to the position illustrated by FIG. 5. In this position the carrier fluid entering the backflush valve 100 through the sampling valve outlet conduit 94 is directed in a second or reverse direction through the chromatographic column 101 to backflush the sample constituents remaining in the column and carry all sample constituents which have not previously been eluted through the column backward through the column and to the detector 104. Although the sample valve 90 is shown in the same position in FIG. 5 as was illustrted by FIG. 4, the sample valve position can be switched to the position illustrated by FIG. 3 in preparation for the taking of a subsequent sample at the same time the backflush valve 100 reverses the flow through the chromatographic column 101.

In FIG. 5A the effect on the detector output signal 105 of backflushing the chromatographic column 101 is illustrated. The base line 110, nonaromatic peak 111, and the beginning of the aromatic peak 112, representing the lighter aromatic constituents having a lower number of aromatic rings, of FIG. 4A are followed by a backflush interruption 114 in the detector output signal 105. This backflush interruption is caused primarily by a temporary disruption of pressures within the detector 104 caused by the switching of the valve 100. Following the reversing of the valve 100, and after a length of time sufficient for the sample constituents remaining within the chromatographic column 101 to be carried back out of the column, a heavy aromatic peak 115 is produced. Comparison of the area under the heavy aromatic peak 115 with the total areas under peaks 111, 112, and 115, or with the total area under peaks 112 and 115, or with the area under peak 112, or comparison in some other similar manner by the ratio integrator 107 will generate an analyzer output signal 14 which is responsive to and/or representative of the ease with which the particular feedstock which was sampled can be cracked.

Determination of the time during operation of the analyzer 12 at which the backflush valve 100 should be actuated can be made based upon analysis of known compositions to determine the time at which the proper division of aromatics to obtain the desired heavy aromatic sample can be accomplished. Useful separations which can be performed in this manner are the separation of single ring aromatics from polynuclear aromatic or polyaromatic structures, separation of those aromatic structures having three or more aromatic rings from those having fewer than three rings, and separation of those aromatic structures having at least four aromatic rings from those having fewer than four rings. Although these and other similar separations can detect a heavy aromatic proportion of the sample which is useful for control purposes, the presently preferred technique is to separate those heavy aromatics having four or more aromatic rings and to utilize a ratio of heavy aromatic to total aromatic content as the analyzer output signal 14. Programming of the proper switching time to obtain the desired sample separation as well as valve switching and chromatograph control necessary to monitor the feedstock being supplied to a continuing process can be accomplished using the same programmer as is used to perform the function of the ratio integrator 107, a Model 102 or Model 112 Programmer manufactured by Applied Automation, Inc., Bartlesville, Oklahoma, for example.

In the operation of a cracking reactor a sample of the feedstock to the reactor, preferably a sample of the fresh feed obtained through conduit 10*a* or a sample of the total feed obtained through conduit 10*c* (FIG. 2), is analyzed and a suitable analyzer output signal 14 responsive to the proportion of heavy aromatics within the feedstock sample is produced. In addition to any preferred proportions discussed herein, other proportions relating the heavy aromatic content of the sample to all or another portion of the sample can be used. The set point signal generator 20 thereupon translates the information contained in the analyzer output signal 14 into a set point signal 18 which has a specific meaning in terms of the process variable to be controlled in response thereto. The specific algorithm by which the set point signal 18 can be generated in response to an analyzer output 14 will depend on the physical configuration of the reactor involved, the chemical properties of the reaction, and other similar circumstances. A proper algorithm suitable for control of a reactor variable can be obtained by any known techniques including, for example, monitoring of actual process conditions and controlled variable values over a suitable range of reactor operation and subsequently determining by any suitable means, such as multiple regression analysis, the relationship between the uncontrolled feedstock composition variable as represented by the analyzer output signal 14 and the one or more controllable variables to be employed in the reactor control system. The set point signal generator 20 can produce a plurality of set point signals such as signals 18*a*, 18*b*, 18*c*, 18*d* and 18*e* of FIG. 2 or can be utilized in supplying information to still other set point signal generating means. The set point signal or signals can thus be used either in conjunction with existing process control systems for a particular reactor or can be incorporated into a completely new control system. As the proportion of heavy aromatics in the sampled feedstock varies, this variation will be reflected in the analyzer output signal 14 and the set point signal generator 16 will generate the proper set point signal 18 to alter the reaction conditions within the cracking zone so that a desired feed conversion level within the cracking zone or a desired reaction product distribution will be maintained.

Although the invention has been described in conjunction with the operation of a fluidized bed catalytic cracker having a fluidized catalyst regenerator associated therewith, the invention is useful in conjunction with any cracking reaction and can be modified for use with other types of cracking reactors by those skilled in the art. Other reasonable variations and modifications are possible within the scope of the foregoing disclosure, the drawing and the appended claims to the invention.

I claim:

1. A method for cracking a hydrocarbon feedstock, said method comprising:

passing said feedstock to a cracking zone;

generating a first signal representative of the ratio of heavy aromatics to total aromatics within said feedstock;

controlling the reaction conditions within said cracking zone in response to said first signal; and removing the cracked hydrocarbon products from said cracking zone.

2. A method in accordance with claim 1 wherein said cracking zone comprises a catalytic cracking zone.

3. A method in accordance with claim 1 wherein said ratio of heavy aromatics to total aromatics is the ratio of polyaromatics to total aromatics.

4. A method in accordance with claim 1 wherein said ratio of heavy aromatics to total aromatics is the ratio of aromatics having 3 or more aromatic rings to total aromatics.

5. A method in accordance with claim 1 wherein said ratio of heavy aromatics to total aromatics is the ratio of aromatics having 4 or more aromatic rings to total aromatics.

6. A method in accordance with claim 1 wherein generating said first signal comprises:

automatically taking a sample of said feedstock;

automatically performing a chromatographic analysis of said sample;

automatically determining, from said chromatographic analysis, the ratio of heavy aromatics to total aromatics within said sample; and automatically establishing said first signal in response to said ratio of heavy aromatics to total aromatics within said sample.

7. A method in accordance with claim 6 wherein automatically performing a chromatographic analysis of said sample comprises:

eluting nonaromatic and light aromatic sample constituents through a chromatographic column to a detector; and subsequently backflushing said chromatographic column and passing the backflushed sample constituent to said detector;

and wherein automatically determining the ratio of heavy aromatics to total aromatics within said sample comprises dividing the area under the chromatographic peak resulting from said backflushed sample constituents by the total area under the backflushed sample constituents peak and the light aromatics peak generated by the detector.

8. A method in accordance with claim 6 wherein controlling the reaction conditions within said cracking zone comprises:

generating at least one set point signal in response to said first signal;

comparing each said set point signal to a process measurement signal;

generating, in response to each said comparison, a control signal; and controlling, in response to each said control signal, at least one condition within said cracking zone.

9. A method in accordance with claim 8 wherein one of said at least one set point signals is representative of the desired temperature of a feedstream to said cracking zone, wherein said process measurement signal is representative of a measured temperature of said feedstream, and wherein controlling said at least one condition in response to the control signal generated by a comparison of said one set point signal and said process measurement signal comprises controlling the amount of heat supplied to said feedstream by a heat exchange means thereby controlling the temperature of material within said feedstream and the amount of heat carried to the cracking zone by said feedstream.

10. A method in accordance with claim 8 wherein one of said at least one set point signals is representative of the desired flow rate of a feedstream to said cracking zone, wherein said process measurement signal is representative of a measured flow rate of said feedstream, and wherein controlling said at least one condition in response to the control signal generated by a comparison of said one set point signal and said process measurement signal comprises controlling the flow rate of said feedstream thereby controlling the amount of material carried to the cracking zone by said feedstream.

11. A method in accordance with claim 8 wherein one of said at least one set point signals is representative of the desired temperature within said cracking zone, wherein said process measurement signal is representative of a measured temperature within said cracking zone, and wherein the said at least one condition controlled in response to the control signal generated by a comparison of said one set point signal and said process measurement comprises controlling the temperature within said cracking zone.

12. A method in accordance with claim 11 wherein said cracking zone comprises a catalytic cracking zone and controlling the temperature within said cracking zone comprises controlling the rate of flow of catalyst to said cracking zone.

13. A method in accordance with claim 8 wherein said cracking zone comprises a fluidized bed catalytic cracking zone, wherein one of said at least one set point signals is representative of the desired fluidized bed level within said cracking zone, wherein said process measurement signal is representative of a measured fluidized bed level within said cracking zone, and wherein controlling said at least one condition is response to the control signal generated by a comparison of said one set point signal and said process measurement signal comprises controlling the flow rate of used catalyst from said cracking zone thereby controlling the amount of catalyst remaining within said cracking zone.

14. A method in accordance with claim 8 wherein said cracking zone comprises a fluidized bed catalytic cracking zone having a catalyst regenerating zone associated therewith, wherein one of said at least one set point signals is representative of the desired flow rate of air to said regenerating zone, wherein said process measurement signal is representative of a measured flow rate of air to said regenerating zone, and wherein controlling said at least one condition in response to the control signal generated by a comparison of said one set point signal and said process measurement signal comprises controlling the flow rate of air to said regenerating zone.

* * * * *